United States Patent [19]

Yoshikawa

[11] 4,181,908

[45] Jan. 1, 1980

[54] DEFLECTION COIL

[75] Inventor: Norio Yoshikawa, Tokyo, Japan

[73] Assignee: Denki Onkyo Co., Ltd., Tokyo, Japan

[21] Appl. No.: 880,477

[22] Filed: Feb. 23, 1978

[30] Foreign Application Priority Data

Feb. 23, 1977 [JP] Japan ..... 52-21132[U]

[51] Int. Cl.[2] ..... H01F 7/00

[52] U.S. Cl. ..... 335/210; 335/213

[58] Field of Search ..... 335/210, 212, 213

[56] References Cited

U.S. PATENT DOCUMENTS

| | | | |
|---|---|---|---|
| 3,895,329 | 7/1975 | Logan et al. | 335/213 X |
| 4,023,129 | 5/1977 | Kratz et al. | 335/213 X |

FOREIGN PATENT DOCUMENTS

| | | | |
|---|---|---|---|
| 2601205 | 7/1976 | Fed. Rep. of Germany | 335/213 |

*Primary Examiner*—George Harris

*Attorney, Agent, or Firm*—Armstrong, Nikaido, Marmelstein & Kubovcik

[57] ABSTRACT

A coil frame comprises guides provided at the front and rear ends of a flared coil bobbin. Each guide has a plurality of circumferentially spaced winding insertion slots. The coil insertion slots in at least one of the guides are formed such that slot depth in the axial direction of a CRT is shallow in the vicinity of a window, with the depth of each slot becoming gradually deeper as the slots become more distant from the window. A deflection coil is formed by winding a deflection coil wire on the coil frame through the coil winding insertion slots of the guides such that a saddle-type deflection coil extends along the inside surface of the coil frame.

2 Claims, 3 Drawing Figures

DEFLECTION COIL

This invention relates to the deflection coil of a deflection yoke adapted to fit about a cathode ray tube, and more particularly to a deflection coil wound in a saddle-type configuration on the inside surface of a coil frame composed of a coil bobbin the front and rear ends of which are provided with guides having a plurality of circumferentially arrayed coil winding insertion slots, the wire of the coil being wound on the inside surface of the coil frame through the insertion slots.

As known deflection yokes of the type described, there can be mentioned, in general, a deflection yoke wherein the wires of both a horizontal deflection coil and vertical deflection coil are wound about a deflection core in a toroidal-type configuration, another in which the wires of both coils are wound along the length of the deflection core in a saddle-type configuration, and a third type in which the saddle configuration is adopted for the horizontal deflection coil and the toroidal configuration for the vertical deflection coil.

As an example of a deflection yoke in which at least one of the deflection coils possesses a saddle-type configuration, there is the invention disclosed in U.S. Patent Application No. 650130 (Shizu), filed on Jan. 19, 1976, now U.S. Pat. No. 4,117,432. According to the disclosure, a coil frame is composed of a coil bobbin the front and rear ends of which are provided with guides having a plurality of circumferentially arrayed coil winding insertion slots, the deflection yoke being formed by winding a deflection coil wire directly on the inside surface of the coil frame through the insertion slots so as to form a saddle-type coil. In this case, however, all of the coil winding insertion slots formed in the guides at each end of the coil frame are designed to have a uniform depth in the axial direction of the CRT. In consequence, although there is no trouble encountered in winding the deflection coil wire in a saddle-type configuration on the inside surface of the coil frame or in maintaining the saddle shape, equal lengths of deflection coil turns come to be wound on the inside surface of the coil frame in the axial direction of the CRT. Accordingly, deflection distortion or misconvergence which appears on the screen of the CRT cannot be corrected by converting the magnetic field distribution to a barrel-shaped configuration at the rear of the deflection yoke through the adoption of a deflection yoke in which the deflection coil turns in the axial direction of the CRT are long in length in the vicinity of a window and gradually shorter in length as the turns become more distant from the window. In the past, distortion and misconvergence was corrected by adjusting the magnetic field distribution into the barrel-shaped conguration at the rear of the deflection yoke through a structure in which the number of wire turns on the inside surface of the coil frame and in the circumferential direction thereof was reduced in the vicinity of the window and successively increased as the turns became more distant from the window.

Accordingly, it is the object of the present invention to provide a deflection coil of which the turns on the inside surface of a coil frame in the axial direction of the CRT are long in length in the vicinity of a window and gradually shorter in length as the turns become more distant from the window, whereby there can be obtained a magnetic field distribution suitable for improving upon distortion or misconvergence on the screen of the CRT.

Briefly, in accordance with the features of the deflection coil of the present invention, a coil frame comprises guides provided at the front and rear ends of a flared coil bobbin. Each guide has a plurality of circumferentially arrayed coil winding insertion slots. The coil insertion slots in at least one of the guides are formed such that slot depth in the axial direction of the CRT is shallow in the vicinity of a window, with the depth of each slot becoming gradually deeper as the slots become more distant from the window. The wire of the deflection coil is wound through the coil winding insertion slots in each guide in a saddle-type configuration extending along the inside surface of the coil frame.

Figure 1:
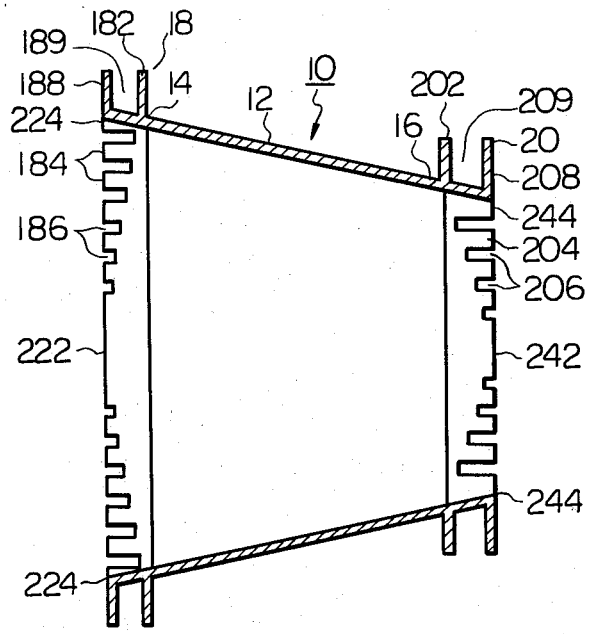
FIG. 1 is a plan view of one-half of a coil frame, as seen from the inward side, employed in winding a preferred embodiment of a deflection coil according to the present invention.

Referring now to FIG. 1, a coil frame 10 comprises a coil bobbin 12 made of an insulating material such as polyphenylene oxide and which is either a flared unitary body or a body constructed by combining a pair of divided flared members, as well as a pair of guides 18, 20 provided at the front end (screen side) 14 and rear end (electron gun side) 16 of coil bobbin 12. The guides 18, 20 include ring-shaped collars 182, 202 and a plurality of coil winding insertion slots 186, 206 formed between a multiplicity of circumferentially arrayed and suitably spaced finger members 184, 204 extending from the collars 182, 202. Each finger member 184, 204 is formed to include at its end projections 188, 208 extending outwardly in the radial direction, the combination of collar 182 and finger members 188, and the combination of collar 202 and finger members 208 forming circumferentially extending annular channels 189, 209. The coil winding insertion slots 186, 206 defined between the finger members 184, 204 of the guides 18, 20 are formed such that slot depth (length) in the axial direction of the CRT is shallow (slot length is short) in the vicinity of windows 222, 242 of guides 18, 20, with the depth of each slot becoming gradually deeper (slot length becomes longer) as the slots become more distant from the windows 222, 242.

Figure 2:
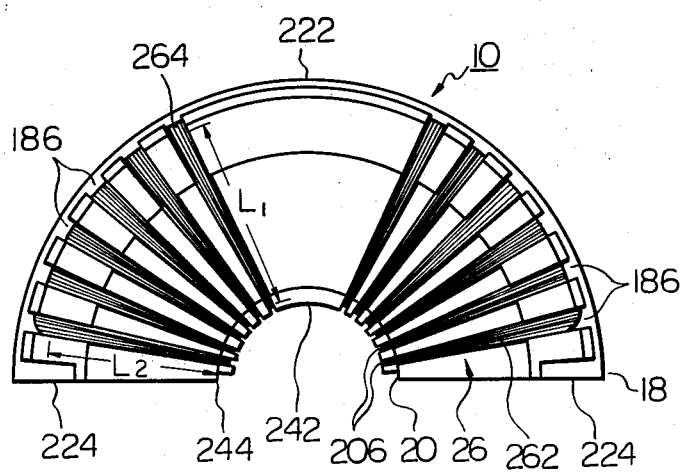
FIG. 2 is a front view of a deflection coil as wound on the coil frame depicted in FIG. 1.

FIG. 2 illustrates deflection coil 26 which possesses a saddle-type configuration as wound on one-half of coil frame 10. Deflection coil 26 is wound in a saddle-type configuration by stretching wires between corresponding ones of coil winding insertion slots 186, 206 defined between the finger members 184, 204 of coil frame guides 18, 20 thereby disposing longitudinal portions 262 along the inside surface of coil frame 10, and by passing the wires through the annular channels 189, 209 formed in guides 18, 20, thereby disposing transverse portions 264 in the channels. Here, the longitudinal portions 262 of deflection coil 26 are formed such that the initial turns, namely turns of a length $L_1$ adjacent the windows 222, 242 of guides 18, 20, are longer than the final turns, namely turns of a length $L_2$ at the greatest distance from the windows 222, 242, this conforming to the decreasing depth of the coil winding insertion slots 189, 209 in guides 18, 20 (in other words, the turns having a length of $L_1$ are longest, with the turns growing progressively shorter until the shortest turn of length $L_2$ is reached). In this case, the length of a turn is taken to mean the distance from coil winding insertion slots 186 to the insertion slots 206.

Figure 3:
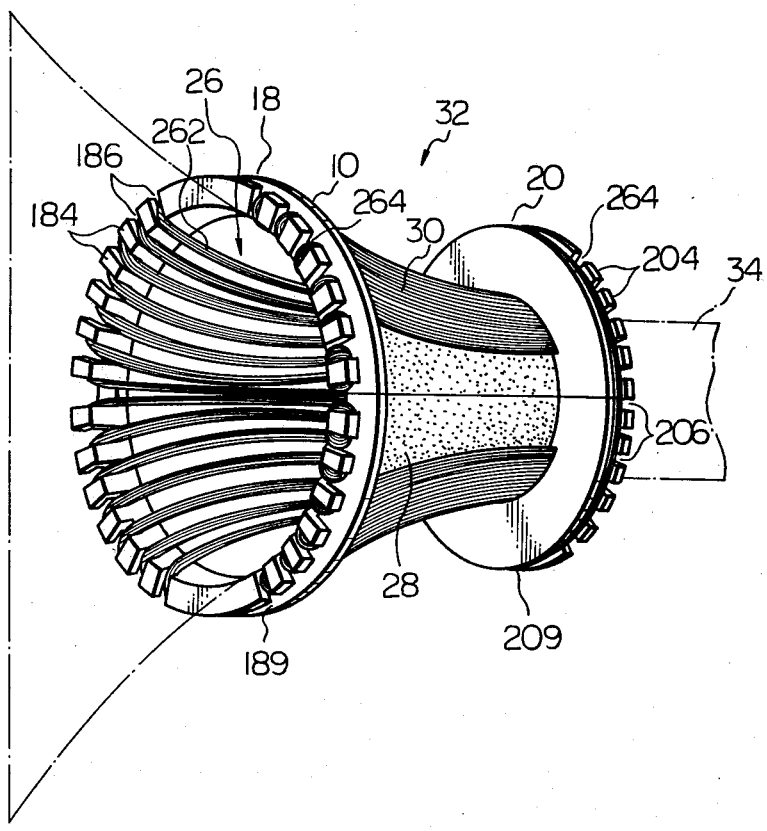
FIG. 3 is a perspective view, as seen from the front, of a deflection yoke composed of a pair of the deflection coils shown in FIG. 2, the deflection yoke being shown as it would appear if fit about a CRT.

FIG. 3 shows a deflection yoke 32 using the deflection coil 26 of the present invention as it would appear if fit about a CRT 34. Deflection coil 26 is employed as a horizontal deflection coil, and a toroidal-type vertical deflection coil 30 wound on a deflection core 28 is attached about the outer periphery of coil bobbin 12 of coil frame 10. According to this construction, the magnetic field distribution generated by horizontal deflection coil 26 is converted to a barrel-shaped configuration at the rear (electron gun side) of deflection yoke 32 by synergism due to the difference in turn length on the inside surface of coil frame 10 and the difference in the quantity of turns in the circumferential direction of coil frame 10 on the inside surface thereof.

While the present invention has been shown and described with reference to a preferred embodiment in which the deflection coil of the invention is employed as the horizontal deflection coil of a deflection yoke, it should be understood that the deflection coil could equally well be used as a vertical deflection coil, and that various other changes or modifications may be made, without departing from the spirit or scope of the present invention.

What is claimed is:

1. A deflection coil having a coil frame and a wire wound thereon, said coil frame comprising a flared coil bobbin and guides provided on the front and rear ends of said coil bobbin integral therewith, wherein the guides at the front and rear ends of said coil bobbin each have a plurality of circumferentially spaced coil winding insertion slots, wherein said coil winding insertion slots in at least one of said guides are formed such that the slot depth in the axial direction of a CRT is shallow in the vicinity of a window formed in the guide, with the depth of each slot becoming successively deeper as the slots become more distant from said window, and wherein the wire of the deflection coil is wound through the coil insertion slots in said guide in a saddle-type configuration along the inside surface of the coil frame.

2. A deflection coil as set forth in claim 1 wherein said at least one of said guides is both of said guides.

* * * * *